United States Patent [19]

Piipponen et al.

[11] Patent Number: 4,848,485

[45] Date of Patent: Jul. 18, 1989

[54] METHOD OF AND AN ARRANGEMENT FOR CONTROLLING ROCK DRILLING

[75] Inventors: Juha Piipponen, Tampere; Ossi Tienari, Kilvakkala, both of Finland

[73] Assignee: Oy Tampella Ab, Tampere, Finland

[21] Appl. No.: 171,449

[22] Filed: Mar. 21, 1988

[30] Foreign Application Priority Data

Mar. 23, 1987 [FI] Finland ..... 871274

[51] Int. Cl.[4] ..... E21B 7/00; E21B 44/00

[52] U.S. Cl. ..... 175/27; 175/220; 299/1; 173/4; 173/13

[58] Field of Search ..... 175/27, 24, 203, 220; 173/2, 4, 11, 13; 299/1

[56] References Cited

U.S. PATENT DOCUMENTS

| | | | |
|---|---|---|---|
| 4,189,183 | 2/1980 | Borowski | 299/1 |
| 4,484,637 | 11/1984 | Mayer | 173/2 |
| 4,501,199 | 2/1985 | Mashimo et al. | 173/11 |
| 4,534,500 | 8/1985 | Jochum | 173/13 |
| 4,751,971 | 6/1988 | Thompson | 175/24 |

FOREIGN PATENT DOCUMENTS

| | | | |
|---|---|---|---|
| 2048/72 | 3/1983 | Finland . | |
| 1138489 | 2/1985 | U.S.S.R. | 175/220 |
| 1146440 | 3/1985 | U.S.S.R. | 175/220 |
| 2103968 | 3/1980 | United Kingdom . | |

*Primary Examiner*—Jerome W. Massie, IV
*Assistant Examiner*—Terry Lee Melius
*Attorney, Agent, or Firm*—Birch, Stewart, Kolasch & Birch

[57] ABSTRACT

A method of and an arrangement for controlling rock drilling when a feeding beam (3) is displaced so that the forward end thereof makes contact with a rock surface to be drilled. The arrangement comprises a displacing device for displacing the feeding beam in the longitudinal direction thereof and a control device for controlling the operation of the displacing device. The control means comprise a control element which is mounted at the forward end of the feeding beam (3) so that when the feeding beam is displaced in the longitudinal direction, the control element is the first to make contact with the rock surface. The control element is connected to stop the operation of the displacing device of the feeding beam (3) when it hits the rock surface. The control element further comprises a detecting element (10) formed by a sleeve-like support and mounted slidably in the longitudinal direction of the feeding beam (3), which detecting element is displaced backwards with respect to the feeding beam (3) when it hits the rock surface; and a spring (12) which pushes the detecting element (10) to its forward position; and a detector (15) which detects the displacement of the element (10) and is connected to control the displacing device of the feeding beam (3).

17 Claims, 2 Drawing Sheets

METHOD OF AND AN ARRANGEMENT FOR CONTROLLING ROCK DRILLING

Figure 1:
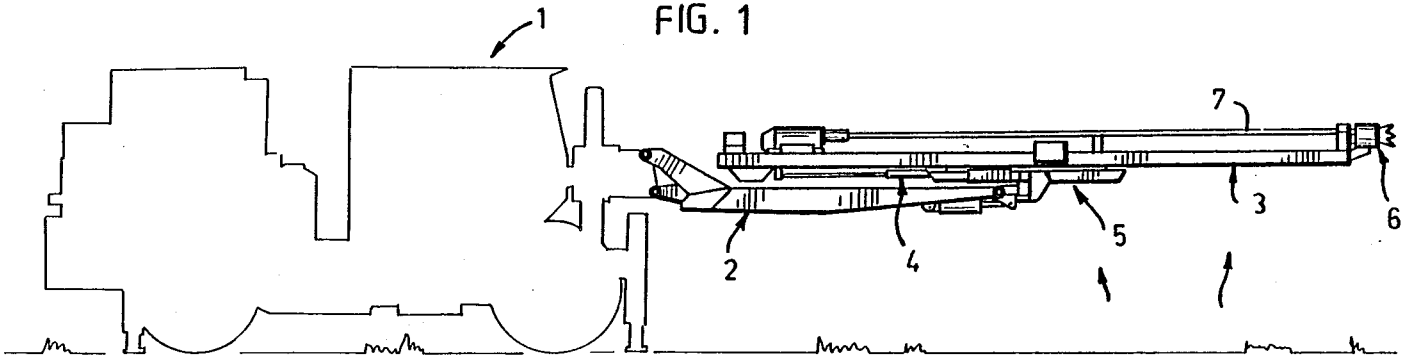

This invention relates to a method of controling rock drilling, wherein a feeding beam of a rock drill machine is positioned in the direction of a hole to be drilled in such a manner that a drill rod is positioned at the hole to be drilled, whereafter the feeding beam is displaced by displacing means in the longitudinal direction thereof towards the surface of the rock to be drilled until the forward end of the feeding beam makes contact with the rock surface and supports the feeding beam on the rock at least at the beginning of the drilling process. The longitudinal movement of the feeding beam is controlled by means of a control element mounted at the forward end of the feeding beam, which control element stops the operation of the displacing means of the feeding beam when it makes contact with the rock surface, whereafter the drilling of the hole is initiated.

The invention is also concerned with an arrangement for controlling a feeding beam of a rock drill machine when the feeding beam is displaced so that the forward end thereof makes contact with the rock surface to be drilled for supporting the feeding beam during the drilling process, comprising displacing means for displacing the feeding beam in the longitudinal direction thereof and control means for controlling the operation of the displacing means, the control means comprising a control element which is mounted at the forward end of the feeding beam so that when the feeding beam is displaced in the longitudinal direction it is the first to make contact with the rock surface, the control element being connected to stop the operation of the displacing means of the feeding beam when it hits the rock surface.

When drilling a hole in a rock, it is of great importance, especially when starting the drilling, to be able to support the forward end of the feeding beam of the drill machine on the rock so as to prevent the displacement of the annular bit along the surface of the rock during the rotation thereof so that the drilling could be started at the desired place. In addition, the movement of the annular bit causes sideward forces in the drill rod which may distort or break the drill rod, which causes breaks in the drilling process and unnecessary costs.

In order to avoid this it has been customary both in manual and automated drilling to first displace the feeding beam to the right drilling position and thereafter push it in the longitudinal direction towards the rock so that a usually tooth-shaped drilling support mounted at the forward end of the feeding beam hits the rock, thus preventing the transverse movements of the forward end of the feeding beam and, consequently, of the annular bit. This procedure has been carried out manually by the driller even though the drilling process would be fully automated otherwise.

Automatic displacement of the feeding beam to a predetermined distance from the rock surface is known per se e.g. from British Pat. Application No. 2 103 968, in which the distance of the feeding beam is adjusted by means of the feeding mechanism of the drill rod and control means attached thereto. According to the teachings of the British patent application, the feeding beam is first positioned in the drilling direction and displaced to some distance from the rock, whereafter the rock drill machine with a drill rod attached thereto is begun to be displaced forwards from its retracted position on the feeding beam until the annular bit hits the rock surface. During the displacement of the drill machine, the distance of displacement thereof is measured, and after the annular bit hits the rock the feeding beam is displaced a distance shorter than the distance of displacement of the rock drill machine so that a predetermined distance remains between the feeding beam and the rock.

The British teachings are applicable to automatic drilling, whereby the control means effect the approaching, measuring and displacing steps automatically without the help of the driller. Besides being slow, a drawback of the teachings is that the feeding beam is not supported on the rock and, as a consequence, disturbances and damages hamper the drilling process.

An object of the present invention is to provide a method and an arrangement which enable an automatic displacement of the feeding beam to the right drilling position so that the forward end thereof is supported on the rock, thus making it easier to start the drilling process. The method according to the invention is characterized in that the control element, which is a sleeve-like drilling support mounted around a drill bit at the forward end of the feeding beam and secured axially slidably in the longitudinal direction of the drill rod, whereby the axial movement of the drilling support with respect to the feeding beam controls the displacing movement of the feeding beam when the support makes contact with the rock.

The arrangement according to the invention is characterized in that the control element comprises a sleeve-like drilling support mounted slidably in the longitudinal direction of the feeding beam and positioned around a drill bit in the retracted position thereof, the drilling support being displaced with respect to the feeding beam backwards in the longitudinal direction thereof when it hits the rock surface; a member which is arranged to push the drilling support to its forward position; and a detector which detects the displacement of the drilling support and is connected to control the displacing means of the feeding beam.

Figure 6:
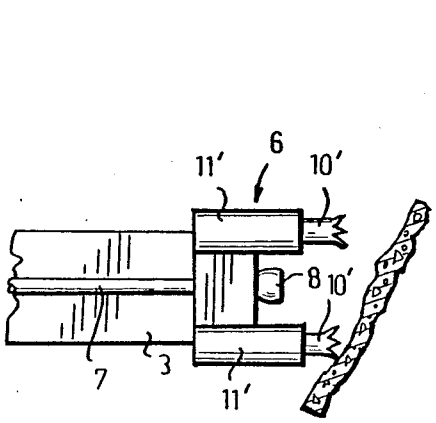
Figure 7:
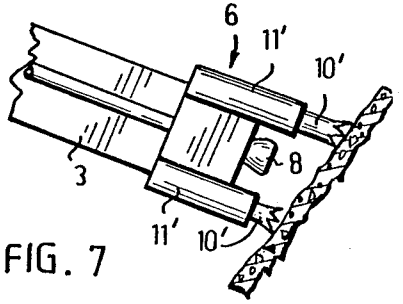
Figure 4:
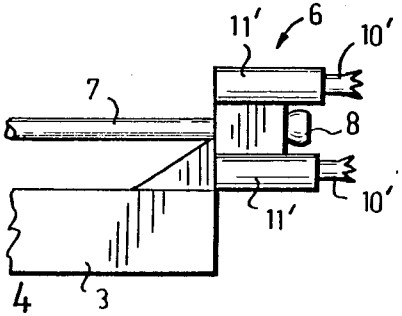
Figure 5:
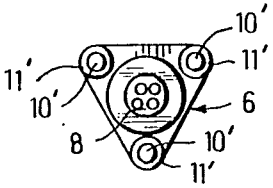
Figure 2:
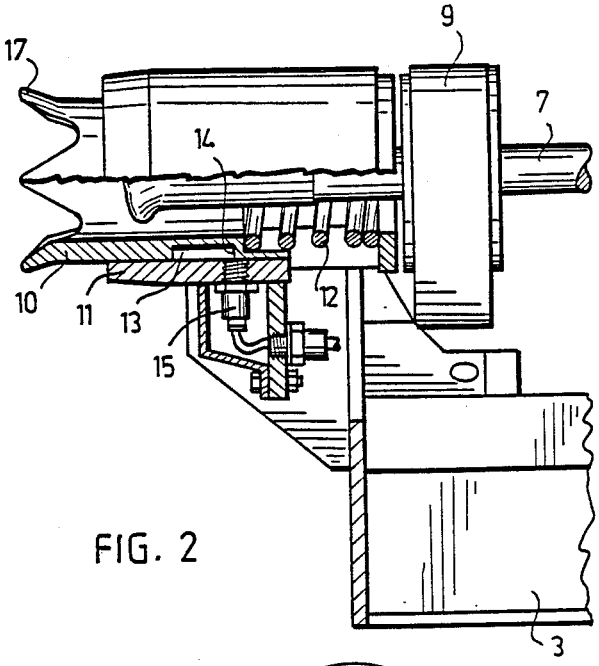
Figure 3:
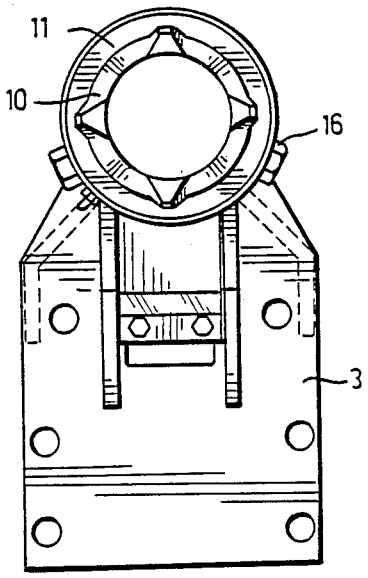

In the following the invention will be described in more detail by means of the attached drawing, whereby FIG. 1 shows a rock drilling equipment with its boom and feeding beam, FIG. 2 is a detailed view of one embodiment of the invention, FIG. 3 is a front view of the embodiment shown in FIG. 2, FIG. 4 is, a side view of another embodiment of the invention, FIG. 5 is a front view of the embodiment shown in FIG. 4, and FIGS. 6 and 7 show the embodiment of FIGS. 4 and 5 in one operational situation.

FIG. 1 shows a rock drilling equipment indicated generally with the reference numeral 1. The rock drilling equipment comprises a boom 2 to which a feeding beam 3 is attached. The feeding beam 3 is displaceable with respect to the end of the boom 2 in the longitudinal direction thereof with displacing means 4 along slide pieces positioned in a cradle 5. The operating device of the displacing means 4 is generally a hydraulic cylinder or the like.

A control element 6 according to the invention is fastened to the forward end of the feeding beam, and a drill rod 7 attached to the rock drilling machine is arranged to be passed through said control element.

The operation and structure of the operating means of the rock drilling equipment, the boom, and the displacing means of the feeding beam are generally known in the art, so they are not described more closely here.

FIG. 2 shows the control element according to the invention. In the figure, the drill rod 7 with an annular bit 8 attached thereto goes through a centralizer 9 known per se. The control element 6 is mounted in front of the centralizer 9 at the forward end of the feeding beam 3. The control element comprises a detecting element in the form of a sleeve-like support 10 positioned around the annular bit 8 and acting as a detecting element, and a body 11 which is fastened to the end of the feeding beam 3. A spring 12 is mounted within the body 11 behind the support 10 between it and the body 11, which spring serves as a means for urging the support 10 forwards, i.e. in a direction away from the feeding beam. For controlling the operation, the support 10 comprises e.g., an annular groove 13, an edge 14 of which is positioned at a detector 15 in the forward position of the support 10. The support 10 is mounted within the body 11 axially slidably but unrotatably e.g. by means of grooves (not shown) provided therein and bolts 16 extending into the grooves through the body.

The detector 15, which operates e.g. by means of electricity or light, is connected to control the displacing means 4 of the feeding beam 3 in such a manner that the displacement of the support 10 from its forward position causes the detetor 15 to generate a control impulse or signal which stops the operation of the displacing means 4.

The equipment operates in such a manner that when the drilling process, for instance, is started by means of an automatic control means, the feeding beam 3 is displaced to the drilling position so that the drill rod 7 is positioned in alignment with the hole to be drilled but at some distance from the surface of the rock. Thereafter the control device starts the displacing means 4 by means of which the feeding beam 3 is displaced along the slide faces in the cradle 5 towards the rock until the support 10 hits the surface of the rock. Since the support 10 is axially displaceable with respect to the body 11, it yields slightly inwards, thus compressing the spring 12, whereby the edge 14 of the groove 13 of the sleeve is displaced away from the detector 15. This causes the detector 15 to generate a control impulse which stops the operation of the displacing means, thus leaving the feeding beam leaning on the surface of the rock by means of the support 10.

The control impulse which stops the operation of the displacing means 4 can simultaneously be used for starting automatically the drilling process, whereby the rock drilling machine and the drill rod 7 begin to move along the feeding beam towards the rock in a manner known per se and the whole drilling process continues conventionally until the next hole is to be drilled.

By using the support 10 according to FIGS. 2 and 3 as a detecting element the movement of which effects the control operation for stopping the feeding movement, a simple and advantageous solution is achieved in which the feeding beam is supported at the beginning of the drilling process, which makes the initiation of the drilling process easier. As shown in the figures, tooth-like prongs 17 preferably positioned symmetrically around the axis of the support 10 can be formed at the end of the support 10, whereby the prongs act as a reliable drilling support as they are able to enter even minor clefts in the rock.

The support 10 may be fastened unrotatably but it can also be mounted rotatably if this is considered necessary. The recess or groove 13 may be provided on the side of the detector 15 only, if the detector 10 is mounted unrotatably, but it can also be a groove extending around the entire sleeve.

The support 10 can be round, angular or elliptical in cross-section or of any other desired shape. If it comprises prongs 17, these are preferably three or more in number.

The detector 15 may be electric or electromagnetic or it may be operated by light, whereby that point of the support 10 which generates the control impulse can be shaped or constructed in a manner required by the use of the detector. The detector may also consist of a switch or the like detector positioned behind the detecting element, so that the detecting element effects the control operation when it presses or approaches the detector.

Instead of the sleeve-like support, the detecting element may consist of a separate body which may be, e.g., tooth-like or of some other shape and which is mounted at the forward end of the feeding beam aside from the axial point of the drill rod so that it extends in front of the annular bit 8 when this is in its retracted position, thus, it is the first to make contact with the rock surface when the feeding beam is displaced towards the rock. As described above, it is possible to detect when such a detecting element hits the rock and, correspondingly, control the operation of the equipment. FIGS. 4 and 5 show a structure formed by three separate detecting means, the detecting element being positioned in a symmetrical array around the annular bit 8. Each detecting means comprises a detecting element 10' and a body 11'. The point of the detecting element 10' may be tooth-like or it may be provided with tooth-like prongs or the like.

The detecting means are connected to control the displacing means of the feeding beam 3 in such a manner that a single detecting element 10' making contact with the rock is enough to stop the displacing movement of the feeding beam. The control means can further be connected to control the drilling process so that if one or more the detecting elements 10' does not make contact with the rock when the displacing movement of the feeding beam is completed, the control means adjusts the altitude of the feeding beam by turning it in the direction of those detecting elements 10' which have not made contact with the rock. The drill rod thereby turns closer to the normal axis of the rock surface, which makes the initiation of the drilling easier. In automatic drilling, the turning and displacing of the feeding beam can be taken into account particularly easily because the feeding beam can be displaced aside from the original drilling axis and this displacement can be taken into account so that the end point of the finished drill hole will be positioned essentially at the same place as originally planned. This operation is illustrated in FIGS. 6 and 7; in FIG. 6, one detecting element 10' only has hit the rock surface. As the detecting element 10' makes contact with the rock, the movement of the feeding beam towards the rock has stopped, but the position of the feeding beam with respect to the surface is too oblique for the drilling to be started reliably. On the basis of the position of the detecting element which has remained out of contact, the control means turns the feeding beam and displaces it further in the sideward direction with respect to the rock wall so that both detecting elements make contact with the rock surface and the drilling process can be started.

The detecting element 10 can further be used for controlling the operation of the drilling equipment in cases where a piece of rock breaks off from under the detector acting as a drilling support on starting the drilling process, whereby the detecting element 10, 10' is able to advance to its forward position. There is thereby a risk of the drill rod being damaged for lack of sufficient support with a resultant break in the drilling process.

In such a case the operation can be controlled, e.g., by measuring the length of the feeding movement of the drill machine, i.e. the advance of the drill rod, and if the advance is smaller than a predetermined distance, the drilling process is interrupted and the drill rod is retracted, whereafter the feeding beam is again displaced forwards until the detecting element again hits the rock and the operation can be continued similarly as originally planned.

If, however, the drilling has advanced beyond a predetermined distance, the drilling can be continued merely by displacing the feeding beam forwards until the detecting element 10 hits the rock surface at the point where the piece of rock broke off.

Both operations can be made to take place automatically, whereby the displacement of the detecting element forwards starts the operation depending on the distance the drill rod has advanced. In the case of too short a boring, the feeding beam is displaced forwards e.g. in response to an impulse generated by the detection of the retracted position of the drill machine, and in the case of a boring exceeding a predetermined length the forward displacement of the feeding beam is initiated by a control impulse generated by the detecting element while it is displaced.

The method and the arrangement according to the invention can also be used in a rock drilling equipment which does not comprise any separate displacing means for the longitudinal displacement of the feeding beam. Thereby the longitudinal movement of the feeding beam is effected, e.g., by turning the boom with respect to the carrier of the device and by simultaneously extending it and by further turning the feeding beam with respect to the end of the boom. In a computer-controlled equipment in particular, this is easy to realize and the boom thereby acts as a displacing means for the longitudinal movement of the feeding beam.

It is further possible to use both the displacing means and the boom as a displacing means effecting the longitudinal movement of the feeding beam.

In addition to automatic drilling, the invention is applicable to manual drilling, whereby the feeding beam can be placed against the rock surface considerably more rapidly than previously. After the driller has started the longitudinal displacing movement of the feeding beam, the movement continues until the detector generates a control impulse which stops the movement and e.g. lights a signal light and/or starts the drilling.

We claim:

1. A method of controlling the operation of a rock drilling machine provided with (1) a feeding beam extending longitudinally between forward and rearward ends, (2) a drill bit carried by the feeding beam, (3) displacing means for displacing the feeding beam in the longitudinal direction thereof, and (4) a sleeve-like drilling support surrounding said drill bit and mounted for longitudinal slidable movement with respect to said feeding beam, the method comprising the steps of:

positioning the feeding beam so as to align the drill bit with a site on a rock surface to be drilled;

advancing said feeding beam to thereby effect an engagement of the drilling support with the rock surface at the site to be drilled, which engagement provides support for said feeding beam and causes a rearward displacement of said drilling support with respect to said feeding beam;

detecting the rearward displacement of said drilling support and generating a control signal in response thereto; and applying said control signal to said displacing means to effect control of the operation of said displacing means.

2. The method defined in claim 1 wherein the step of applying said control signal to said displacing means stops the operation of said displacing means.

3. The method defined in claim 2 further comprising the step of starting a drilling operation in the rock surface after stopping the operation of said displacing means.

4. In a drilling machine having a feeding beam extending longitudinally between forward and rearward ends, a drill bit carried by the feeding beam, displacing means for displacing the feeding beam in the longitudinal direction thereof, and control means for controlling the operation of said displacing means:

said control means comprising a control element mounted at the forward end of said feeding beam, said control element comprising (1) a sleeve-like drilling support surrounding said drill bit and mounted for longitudinal slidable movement with respect to said feeding beam, (2) means for urging said drilling support in the forward direction and (3) a detector for detecting the displacement of the drilling support, said detector being connected to the displacing means for effecting the control thereof, whereby as said feeding beam is advanced toward a surface to be drilled, engagement of the drilling support with the surface provides support for said feeding beam and causes a relative rearward displacement of the drilling support which is detected by said detector to thereby effect a control of said displacing means.

5. The control means defined in claim 4 wherein said detector is operable to stop the operation of said displacing means upon detecting a relative rearward displacement of said drilling support.

6. The control means defined in claim 5 wherein said detector is further operable to start a drilling operation in the surface after stopping the operation of said displacing means.

7. The control means defined in claim 4, 5 or 6 wherein said drilling support is provided with a recess and said detector is operable to detect the displacement of an edge of said recess.

8. The control means defined in claim 4, 5 or 6 wherein said means for urging said drilling support is a spring.

9. The control means defined in claim 7 wherein said means for urging said drilling support is a spring.

10. The control means defined in claim 4, 5 or 6 wherein said sleeve-like drilling support has a leading edge provided with at least three tooth-like prongs positioned substantially symmetrically about the longitudinal axis of said drilling support.

11. In a drilling machine having a feeding beam extending longitudinally between forward and rearward ends, a drill bit carried by said feeding beam, displacing means for effecting displacements of said feeding beam, and control means for controlling the operation of said displacing means:

said control means comprising a control element mounted at the forward end of said feeding beam, said control element comprising (1) a plurality of drilling supports positioned in an array around said drill bit and each mounted for longitudinal slidable movement with respect to said feeding beam, (2) means for urging said drilling supports in the forward direction and (3) a detector for detecting the displacement of the drilling supports, said detector being connected to the displacing means for effecting the control thereof, whereby as said feeding beam is advanced toward a surface to be drilled, engagement of the drilling supports with the surface provides support for said feeding beam and causes a relative rearward displacement of the drilling supports which is detected by said detector to thereby ffect a control of said displacing means.

12. The control means defined in claim 11 wherein said detector is operable to stop the operation of said displacing means upon detecting a relative rearward displacement of said drilling supports.

13. The control means defined in claim 12 wherein said detector is further operable to start a drilling operation in the surface after stopping the operation of said displacing means.

14. The control means defined in claim 13 wherein said detector is further operable to generate a signal in response to detecting a displacement of at least one but less than all of said drilling supports, and said displacing means is operable in reponse to said signal to adjust the attitude of said feeling beam to a substantially normal relationship with respect to the surface.

15. The control means defined in claim 11 wherein there are three drilling supports positioned in a symmetrical array around said drill bit.

16. The control means defined in claim 11 wherein the drilling supports are sleeve-like elements.

17. The control means defined in claim 16 wherein the means for urging said drilling supports are springs.

* * * * *